US007883752B2

(12) United States Patent
Auvil

(10) Patent No.: US 7,883,752 B2
(45) Date of Patent: Feb. 8, 2011

(54) TABLE TOP TOPIARY

(76) Inventor: Tonya Auvil, 7809 Oak Haven La., Stanley, NC (US) 28164

( * ) Notice: Subject to any disclaimer, the term of this patent is extended or adjusted under 35 U.S.C. 154(b) by 145 days.

(21) Appl. No.: 12/254,057

(22) Filed: Oct. 20, 2008

(65) Prior Publication Data

US 2010/0097744 A1 Apr. 22, 2010

(51) Int. Cl.
*A01N 3/00* (2006.01)

(52) U.S. Cl. ..... 428/19; 47/40.5; 248/519; 428/20

(58) Field of Classification Search ..... 248/519, 248/125.8; 47/40.5, 44, 47, 46, 70; 135/16, 135/910; 428/18, 19, 20, 23; 362/122, 123, 362/567, 568, 806; 211/196, 205; 108/50.12
See application file for complete search history.

(56) References Cited

U.S. PATENT DOCUMENTS 3,906,215 A * 9/1975 Dinicola ..... 362/122
4,734,301 A * 3/1988 McKinney ..... 428/8
6,458,435 B1 * 10/2002 Lai ..... 428/20
7,585,552 B2 * 9/2009 Meseke ..... 428/19
7,614,600 B1 * 11/2009 Smith et al. ..... 248/519
7,666,483 B2 * 2/2010 Barthelmess ..... 428/19
2004/0031513 A1 * 2/2004 Bunch et al. ..... 135/910
2004/0221883 A1 * 11/2004 Nipke ..... 135/16

* cited by examiner

*Primary Examiner*—Ramon O Ramirez
(74) *Attorney, Agent, or Firm*—Clements Bernard PLLC; Gregory N. Clements

(57) ABSTRACT

This invention relates to a decorative assembly that is placed above a table to enhance the aesthetic appeal of the surrounding area. The present invention is an assembly that fits through the center hole of a garden or patio table designed to accommodate a center, pole supported umbrella. The invention comprises interchangeable, decorative elements that can be used year round in garden or patio table and has means to provide electricity to the decorative elements through any standard electrical outlet.

3 Claims, 5 Drawing Sheets

TABLE TOP TOPIARY

BACKGROUND OF THE INVENTION

This invention relates to a decorative assembly that is placed above a table to enhance the aesthetic appeal of the surrounding area. More specifically, the present invention relates to an assembly that fits through the center hole of a garden or patio table designed to accommodate a center, pole supported umbrella. More particularly, the present invention relates to interchangeable, decorative elements that can be used year round in garden or patio tables.

Beach umbrellas have enjoyed wide use for numerous years as an easy, convenient way to provide shade where sun is abundant. Beach umbrellas typically consist of a center pole or rod with a plurality of hinged ribs radiating outwardly from the center pole. A piece of cloth, or other lightweight material, is generally affixed to the ribs and sewn such that when the ribs are extended away from the center pole, the cloth or material is extended and is taught between the ribs forming a dome-like structure. This way, any precipitation that falls onto the cloth will not puddle, but rather will roll off. This creates a shelter from the precipitation.

Eventually, garden and patio tables were adapted to take advantage of the popularity of umbrellas and umbrella-like structures as protection from the sun, rain, and elements in general. Such garden and patio tables were designed with a hole in the center to accommodate the center pole which supported the umbrella. Beach umbrellas are used in these garden and patio tables to provide a covering for the table. When in use, the ribs of the umbrella are extended and the umbrella forms a canopy over the table. When not in use, typically the ribs are lowered and the umbrella collapsed with the cloth material bunching together. Since the cloth material is bunched together around the center pole of the umbrella, it typically is not aesthetically pleasing. Typically the configuration of the garden or patio table is such that the umbrella can be removed when not in use; however, this leaves the center hole unused.

Accordingly, there is a need for an aesthetically pleasing apparatus to be placed into the center hole in a garden or patio table when the umbrella is removed. Further, a need for interchangeable, decorative elements that can be used year round with garden and patio furniture exists. Further, a need exists for a decorative apparatus that provides electrical power to decorative elements exits.

U.S. Pat. No. 4,942,693 to Sibold discloses a decorative plant support. The decorative plant support taught by Sibold is generally in an umbrella shaped pattern and contains a plurality of support hubs and slats. However, Sibold does not teach an apparatus that provides electrical power to the decorative elements. Thus, a need exists for an apparatus that provides electricity to the decorative elements exits. The present invention solves this long-felt need.

BRIEF SUMMARY OF THE INVENTION

The present invention is directed to a table top topiary that can be used with a garden or patio table. The invention further has an elongated center pole that extends upwardly through the center hole in the garden or patio table. The invention further has an upper, decorative element that is removably attached to the center pole and is of an aesthetically pleasing appearance. The present invention further contains means for conducting electricity via an AC/DC adaptor or a battery pack at its base up to the decorative element such that the decorative element can power lights or other electrical devices.

The present invention also contemplates a plurality of decorative elements for use with the invention. It is further an object of the invention to provide multiple removable tops that can be interchanged depending on the desires of the user. For example, a decorative element appearing like a Christmas tree could be used in December and a decorative element appearing like a snowman could be used in January. As can be readily seen, the present invention contemplates numerous embodiments that are interchangeable and designed to appeal to a wide range of aesthetic tastes.

The present invention is directed generally to an apparatus for displaying decorative elements. The present invention contemplates a first support pole and a second support pole that are securely fastened to each other, but that can be removed by the user. The present invention also contemplates a manner of conducting electricity extending from the first support pole and passing upwardly to the second support pole. This can be any conventional means to conduct electricity such as a wire or battery. Also, the present invention contemplates further providing a number of rods affixed to the second support pole that form a decorative shape or that can support decorative elements.

The present invention is also directed toward an apparatus having a base that provides stability and will withstand a variety of weather conditions. The invention also consists of a support hub affixed to the second support pole and a plurality of rod supports affixed to said support hub. In addition, a number of rods are affixed to the support hub such that the rods form a decorative shape or can support decorative elements.

The present invention also comprises an electrical wire that transfers electricity from the first support pole to the second support pole. The invention contemplates using a female plug affixed to the end of the first support pole and a male plug affixed to the end of the second support pole. The invention allows the plugs to align such that when said second support pole is inserted into said first support pole said male plug is inserted into said female plug and electricity is provided to the second support pole and the decorative elements.

In addition, the present invention consists of an aligning slot corresponding to a protrusion on the male plug. As the second support pole containing the male plug is inserted into the first pole, the slot captures the protrusion and rotates the second pole until it is in proper alignment.

The present invention is also directed to an apparatus with rod supports that contain protrusions from the interior of the rod supports to securely hold the rods at varying angles. Thus the user can set the rod in a fixed position at any number of angles with respect to the support pole.

The invention also contemplates using a female plug with a drain hole. The drain hole should be large enough to allow moisture to drain from the apparatus. Also, the invention consists of a male plug is that has a drain hole to allow moisture to drain from the apparatus. Thus, any moisture that accumulates as a result of weather conditions will drain out of the apparatus. This will aid in the prevention of rust and extend the life of the invention.

The present invention is intended to consist of a decorative element affixed to the rods. Any number of various decorations can be placed upon the rods. Also, it is contemplated that the invention will consist of rods where the rods can be configured to define an aesthetically pleasing shape. For example, the rods can be configured in a Christmas tree shape, generally an inverted cone. The present invention can also configure its rods in varying configurations and shapes to represent many other different items.

Moreover, the present invention is directed to a method of providing an interchangeable, decorative table top topiary consisting of the above described apparatus. This method includes providing a first support pole and a second support pole that are attached but removable. Also, providing electrical connections from an electrical source, typically an electrical outlet or rechargeable or replaceable battery pack within the support pole or base, extending into the first support pole and passing upwardly into the second pole. Thereby providing electricity to said second support pole and the attached rods or decorative elements.

DETAILED DESCRIPTION OF THE INVENTION

Figure 1:
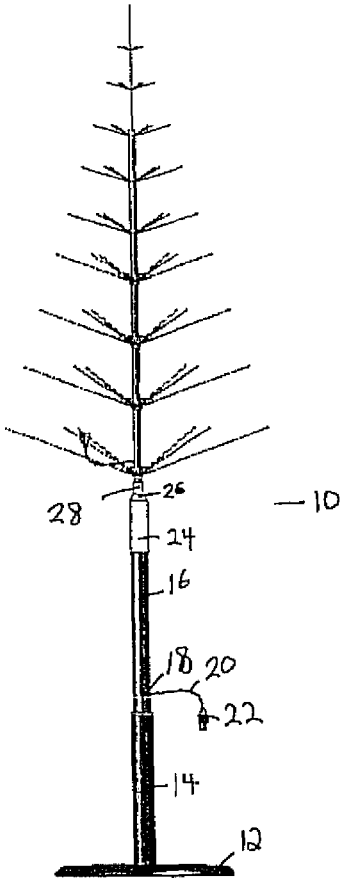
FIG. 1 is a perspective view of the table top topiary.

In FIG. 1 of the drawings, the table top topiary is generally referred to with the numeral 10 and shown to include a base 12. An elongated support pole 14 is affixed to the base and extends vertically from the base 12. The base 12 is constructed such that it rests on a flat surface, typically the floor or ground, and provides stability to the table top topiary 10. In an alternative embodiment, the base can be adapted to contain batteries to provide electricity to the topiary. Extending from the elongated support pole 14 is another elongated pole 16 that extends vertically upward from the elongated support pole 14. The elongated pole 16 is constructed with a hole 18 near the end extending into the elongated support pole 14 such that an electrical cord 20 may pass through the hole 18 into the elongated pole 16. In an alternative embodiment, the elongated pole 16 can be adapted to contain a rechargeable battery to provide electrical power to the topiary. The electrical cord 20 is fitted with an electrical plug 22 adapted to plug into a standard outlet to receive electricity. The elongated support pole 14 is constructed to have a circumference such that the elongated pole 16 will slide into the elongated support pole 14 and be held in a secure position due to frictional forces. Thus, stability of the elongated pole 16 is maintained as the elongated pole 16 continues upward.

Figure 2:
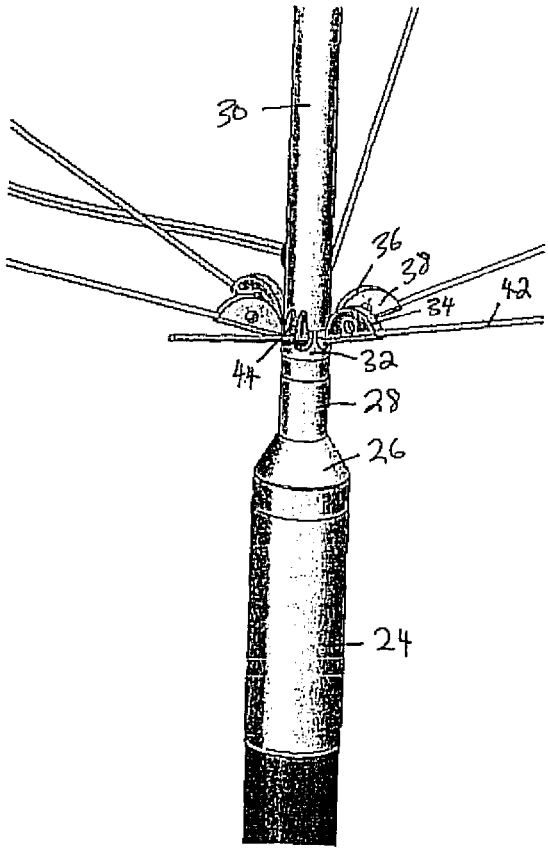
FIG. 2 is an enlarged view of the protective cap and the joinder of the support pole to the elongated pole.

Referring now to FIG. 2, a protective cap 24 is shown. The protective cap 24 is sized to fit over the elongated pole 16 and serves as a stabilizer and as a protector for the enclosed electrical components. The protective cap 24 slopes inward and up at the upper end forming a cone shape that decreases in diameter. This cone shape 26 decreases the diameter of the protective cap 24 and ends in a shorter cap 28. The shorter cap 28 is secured to and covers an end of an elongated topiary support pole 30 that extends upward and downward from the shorter cap 28 and supports the topiary structure.

Still referring to FIG. 2, the protective cap 24 is shown illustrating the cone shape 26 and the shorter cap 28. The support pole 30 extends upward from the shorter cap 28 to a predetermined height. The circumference of the support pole 30 is such that it fits into the shorter cap 28 of the protective cap 24 and is securely held in position. Wrapped around the support pole 30 is a band 32 that has a plurality of semi-circular supports 34 secured to the band 32. The semi-circular supports 34 are affixed to the band 32 such that the semi-circular supports 34 are at a fixed angle relative to the support pole 30. The semi-circular supports 34 are angled to slope upward toward the top of the table top topiary 10. This allows the semi-circular supports 34 to maintain a predetermined angle relative to the support pole 30. The band 32 is attached to the support pole 30 such that it is maintained in a fixed location and is prevented from sliding up and down the support pole 30. Further, the band 32 is attached to the support pole 30 securely enough that additional weight and pressure added to the band 32 will not dislodge the band 32 from the support pole 30 and allow the band 32 to move along the support pole 30. It is also contemplated that the support pole 30 could be constructed to include the semi-circular supports 34 thereby eliminating the need for the band 32.

Figure 3:
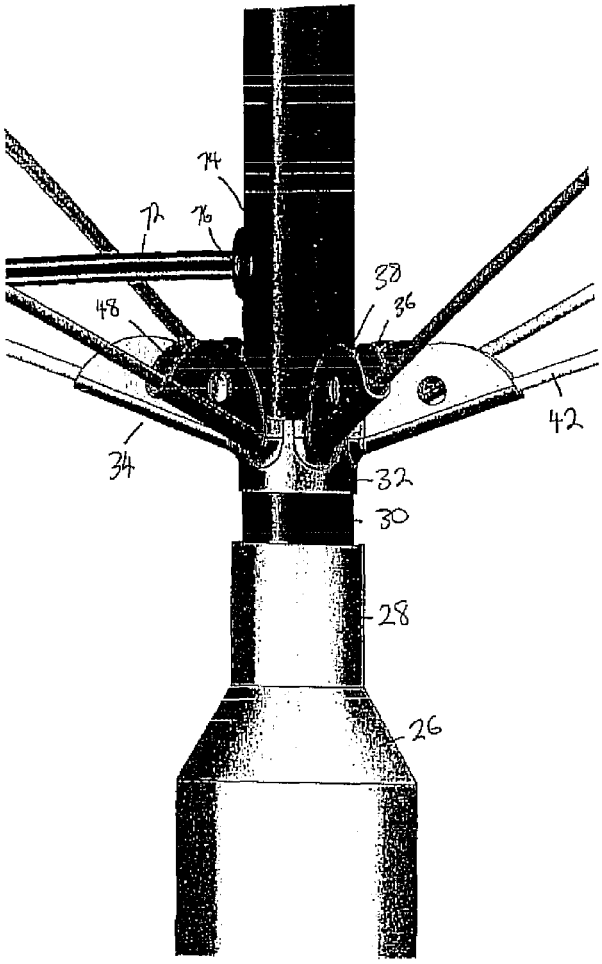
FIG. 3 is an enlarged view of the protective cap and the semi-circular supports.
Figure 4:
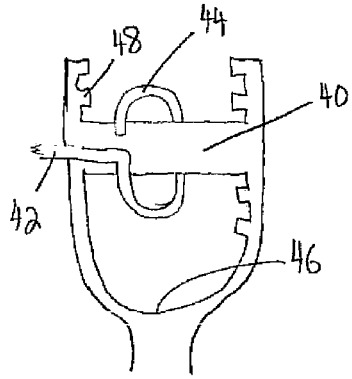
FIG. 4 is front view of the semi-circular support.

Referring now to FIGS. 2, 3, and 4, the semi-circular supports 34 are constructed in a generally "U" shape with a first wall 36 facing a second wall 38 and defining a space therebetween. The first wall 36 and the second wall 38 join to define an axel 40. A rod 42 with one end forming a loop 44 is secured around the axel 40 such that the rod 42 is rotatably fixed to the axel 40. When rotated down toward the protective cap 24, the rod 42 rests upon the bottom surface 46 of the semi-circular support 34. Thus, the rod 42 can support decorative elements whose weight is supported by the rod 42 pressing against the bottom surface 46 and the rod 42 is held in place by the axel 40. The rod 42 can rotate upward toward the support pole 30 and come to rest against the support pole 30 thereby providing a compact configuration for storage when the table top topiary 10 is not in use. A plurality of semi-circular supports 34 can be affixed to the band 32 or incorporated into the support pole 30 such that the semi-circular supports 34 will extend from the support pole 30 at varying radians.

It is further contemplated that the semi-circular supports 34 can be configured in a manner to support the rods 42 at varying angles relative to the support pole 30. Thus, the rods 42 supporting decorative elements can be configured at varying angles relative to the support pole 30 thereby holding the rods 42 at varying angles relative to the support pole 30. Moreover, it is contemplated that the first wall 36 and the second wall 38 may have protrusions 48 extending toward the opposing wall (36 or 38) such that the protrusions 48 will support the rod 42 at varying angles relative to the supporting pole 30. Thus, the rod 42 can be adjusted by the user to maintain any number of different angles relative to the support pole 30. Conceivably the rod 42 can be made of any number of different materials including metal, plastic, wood, etc., that would be strong enough to maintain the weight of various decorations.

As can be easily seen with reference to FIG. 1, a plurality of bands 32 and semi-circular supports 34 can be affixed to the support pole 30. The rods 42 can be of differing length and width, and the loop 44 can also be of varying sizes. Further, the bands 32 and semi-circular supports 34 can be of varying sizes as well. In a preferred embodiment, the sizes of the bands 32, rods 42, and semi-circular supports 34 would decrease toward the top of the support pole 30. This will allow the heaviest or bulkiest decorative items to be placed on the lower rods 42 with lighter or smaller decorative elements placed on higher rods 42. Further, the rods 42 can be affixed to the support pole 30 directly, without using a semi-circular support 34. Affixing rods 42 directly to the support pole 30 is preferably done in a manner such that the rod 42 is at an angle relative to the support pole 30 such that the weight of a decorative element will not bend, deform, flex, or otherwise damage the rod 42 or support pole 30. As can readily be seen, combinations of rods 42 directly affixed to the support pole 30 and rods 42 attached to the support pole 30 by the semi-circular supports 34 can be used through out the table top topiary 10.

Figure 5:
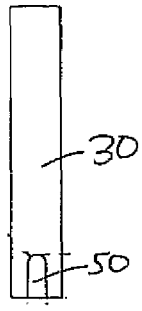
FIG. 5 is an enlarged cross-section view of the bottom of the support pole.
Figure 6:
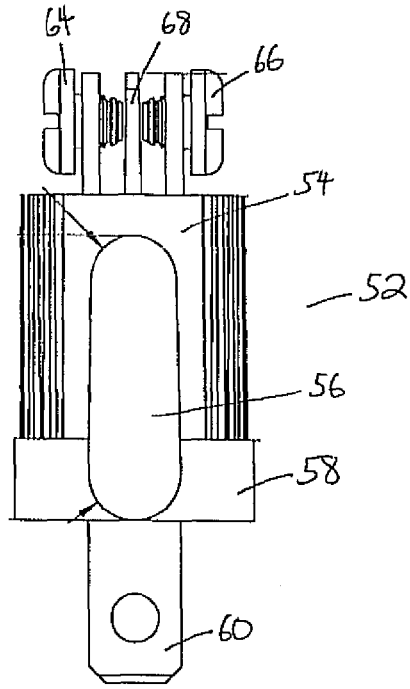
FIG. 6 is an enlarged side view of the male plug.

Referring now to FIG. 5 and FIG. 6, the support pole 30 is preferably configured to define at the lower end a slot 50 for securely holding a male plug 52. The male plug 52 is configured with a housing 54 generally configured in a cylindrical shape. The size of the housing 54 is determined by the inside diameter of the support pole 30 such that the male plug 52 can slide into an open end of the support pole 30. Thus, the internal diameter of the open end of the support pole 30 is sized slightly larger than the outside diameter of the housing 54 such that when the male plug 52 is slid into the end of the support pole 30 the male plug 52 is held securely by frictional forces. Further, the housing 54 also includes a raised lip 56 sized such that it fits securely within the slot 50 at the lower end of the support pole 30. The raised lip 56 prevents insertion of the male plug 52 into the lower end of the support pole 30 at random angles. The raised lip 56 ensures that the male plug 52 can only be inserted into the support pole 30 at a predetermined radial angle. The raised lip 56 is sized such that when the male plug 52 is inserted into the support pole 30 the raised lip 56 fits tightly within the slot 50. Thus, the male plug 52 is further held by frictional forces between the raised lip 56 and the slot 50. It should be readily understood, however, that the male plug may be secured to the support pole 30 by any conventional means such as a pin, screw, etc.

The male plug 52 is further configured to have a cap 58 at the lower end such that the cap 58 encircles the bottom end of the male plug 52 and protrudes slightly outward from the housing 54 of the male plug 52. The cap 58 runs circumferentially around the outside diameter of the housing 54 but does not protrude outwardly as far as the raised lip 56. Thus, the raised lip 56 protrudes beyond both the housing 54 and the cap 58. The cap 58 is sized such that the outside diameter of the cap 58 slightly exceeds the internal diameter of the support pole 30. Thus, when the male plug 52 is inserted into the end of the support pole 30, the male plug slides into the support pole 30 until the cap 58 abuts the end of the support pole 30 thereby preventing the male plug 52 from continuing into to the support pole 30. Preferably, the male plug 52 is configured such that the dimensions of the cap 58 and the raised lip 56 are such that when the male plug is inserted into the support pole the cap 58 contacts the end of the support pole 30 at the same time the raised lip 56 reaches the end of the slot 50. At this point the progress of the male plug 52 into the support pole 30 is arrested by both the cap 58 and the raised lip 56.

Figure 7:
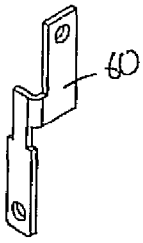
FIG. 7 is an enlarged perspective view of the blade.
Figure 8:
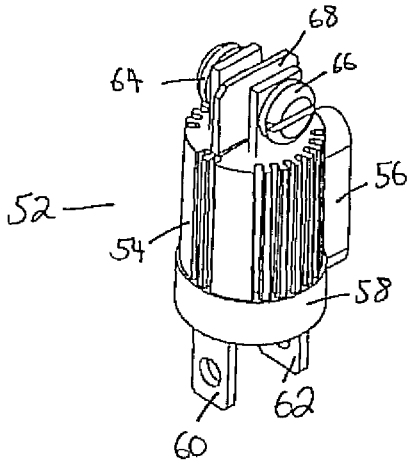
FIG. 8 is an enlarged perspective view of the male plug.

As can be easily seen from FIGS. 6, 7, and 8, the male plug 52 is further configured to contain a first blade 60 and a second blade 62 which protrude from the bottom of the male plug 52 near the cap 58. The first blade 60 and the second blade 62 are constructed such that they extend through the body of the male plug 52 and extend out the top. The first blade 60 and the second blade 62 are constructed of a conductive metal such that electricity is easily conducted through the first blade 60 and the second blade 62. The first blade 60 and the second blade 62 are spaced apart in the male plug 52 at a standard distance for typical electrical outlets. The first blade 60 extends through the housing 54 and protrudes from the top of the housing 54. The top end of the first blade 60 defines an opening that accommodates a first screw 64. The first screw 64 is removably connected to the first blade 60 such that an electrical wire 72 (see FIG. 3) can be secured between the first screw 64 and the top end of the first blade 60. Thus, electricity is conducted from the first blade 60 to the electrical wire 72 as a result of contact between the electrical wire and the first blade 60. Likewise, the second blade 62 is also configured to define an opening that accommodates a second screw 66. The second screw 66 is removably connected to the second blade 62 such that an electrical wire 72 can be secured between the second screw 66 and the top end of the second blade 62. Thus, electricity is conducted from the second blade 62 to the electrical wire 72 as a result of contact between the electrical wire and the second blade 62.

The first blade 60 and the second blade 62 are configured and positioned with the male plug 52 such that the top end of the first blade 60 is in opposite relation to the top end of the second blade 62. Further, the male plug 52 includes an extension 68 from the top of the housing 54 that separates the first screw 64 from the second screw 66 and prevents the potential for the secured electrical wires from touching one another and causing a short circuit. Preferably the extension 68 is constructed of the same non-conducting material as the housing 54. The first screw 64 and the second screw 66 are sized such that when connected to the first blade 60 and the second blade 62, they define an area small enough to be inserted within the support pole 30. Thus, when the male plug 52 is inserted into the support pole 30, the support pole 30 hides and protects the first screw 64 and the second screw 66 from view.

Referring to FIG. 6 and FIG. 3, the present invention provides an upper wire 72 connected to the first screw 64 and the second screw 66. The upper wire 72 is designed to carry electricity from the male plug 52 to the decorative elements of the table top topiary 10. The upper wire 72 runs upwardly through the support pole 30 from the male plug 52 to an upper opening 74 in the support pole 30. The upper opening 74 is defined by the sides of the support pole 30 and is configured to be small enough for the upper wire 72 to pass through. Preferably a grommet 76 is placed over the upper opening 74 to prevent the upper wire from rubbing against the edge of the upper opening 74 in the support pole 30.

Figure 10:
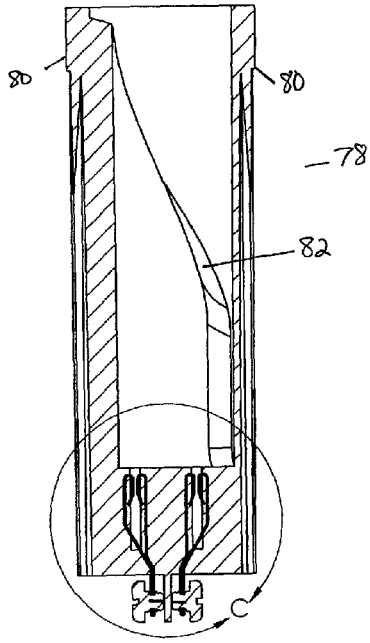
FIG. 10 is an enlarged, cross-sectional view of the aligning tube.
Figure 11:
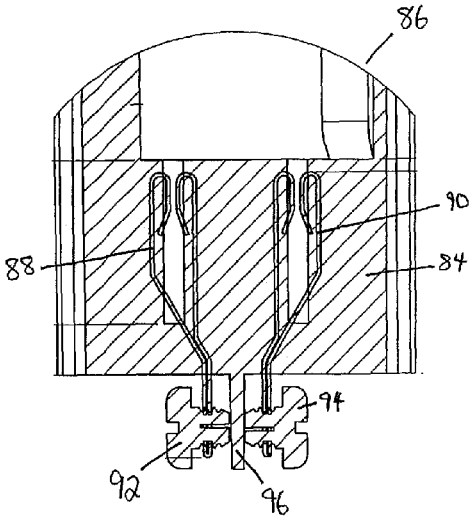
FIG. 11 is an enlarged, cross sectional view of the female plug.

Referring back to FIG. 1 and to FIG. 10, the elongated pole 16 is affixed to an aligning tube 78 that is secured to the top end of the elongated pole 16. The aligning tube 78 fits inside the top end of the elongated pole 16 and is supported by frictional forces and an aligning lip 80 that protrudes from the aligning tube 78 such that when the aligning tube 78 is slid into the elongated pole 16 the aligning lip 80 abuts the top edge of the elongated pole 16 preventing the aligning tube from sliding further into the elongated pole 16. The interior of the aligning tube 78 defines a groove 82 that wraps around the interior of the aligning tube 78. The groove 82 corresponds to the raised lip 56 (see FIG. 6) on the male plug 52. When the support pole 30 is slid into the aligning tube the groove 82 will capture the raised lip 56 and force the support pole 30 to rotate until it is in proper alignment with the elongated pole 16. Once the proper alignment is achieved, the groove straightens out and progresses vertically with respect to the elongated pole 16.

The aligning tube 78 further comprises a female plug 86. The female plug 86 is configured to contain a first receiver blade 88 and a second receiver blade 90 which are housed in the upper portion of the female plug 86. The first receiving blade 88 and the second receiving blade 90 are constructed such that they extend down through the body of the female plug 86 and extend out the bottom of the aligning tube 78. The receiving first blade 88 and the second receiving blade 90 are constructed of a conductive metal such that electricity is easily conducted through the first receiving blade 88 and the second receiving blade 90. The first receiving blade 88 and the second receiving blade 90 are spaced apart in the female plug 86 at a standard distance for typical electrical outlets. The first receiving blade 88 extends down through the female plug 86 and protrudes from the bottom. The bottom end of the first receiving blade 88 defines an opening that accommodates a first receiving screw 92. The first receiving screw 92 is removably connected to the first receiving blade 88 such that an electrical wire (not shown) can be secured between the first receiving screw 92 and the bottom end of the first receiving blade 88. Thus, electricity is conducted from the first receiving blade 88 to the electrical wire (not shown) as a result of contact between the electrical wire and the first receiving blade 88. Likewise, the second receiving blade 90 is also configured to define an opening that accommodates a second receiving screw 94. The second receiving screw 94 is removably connected to the second receiving blade 90 such that an electrical wire (not shown) can be secured between the second receiving screw 94 and the bottom end of the second receiving blade 90. Thus, electricity is conducted from the second receiving blade 90 to the electrical wire (not shown) as a result of contact between the electrical wire and the second receiving blade 90.

The first receiving blade 88 and the second receiving blade 90 are configured and positioned within the female plug 86 such that the bottom end of the first receiving blade 88 is in opposite relation to the bottom end of the second receiving blade 90. Further, the female plug 86 includes a bottom extension 96 from the bottom of the female plug 86 that separates the first receiving screw 92 from the second receiving screw 94 and prevents the potential for the secured electrical wires from touching one another and causing a short circuit. Preferably the bottom extension 96 is constructed of the same non-conducting material as the female plug 86 and the housing 54. The first receiving screw 92 and the second receiving screw 94 are sized such that when connected to the first receiving blade 88 and the second receiving blade 90, they define an area small enough to fit within the elongated pole 16. Thus, the female plug 86 as part of the aligning tube 78 is contained within the elongated pole 16 protected from view.

Figure 9:
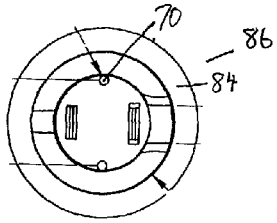
FIG. 9 is a top view of the female plug.
Figure 12:
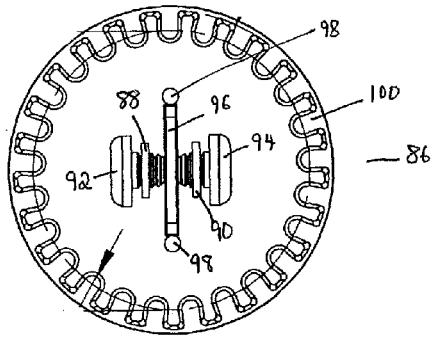
FIG. 12 is a bottom view of the female plug.

Referring to FIG. 9 and FIG. 12, the female plug 86 is preferably constructed to have a drain hole 70 running through the female plug 86. The drain hole 70 is large enough to allow water to pass through the female plug 86 and drain down toward the base 12. The drain hole 70 advantageously allows moisture from condensation, rain, snow, or the like that has collected inside the support pole 30 to drain. This aids in the prevention of rust and other detrimental effects caused by moisture. It is contemplated that the female plug 86 can be constructed with a plurality of drain holes 70. Further, the female plug could be constructed such that the female plug housing 84 has grooves (not shown) that traverse the female plug's 86 longitudinal axis and continue through the elongated pole 16. Such grooves will allow the moisture to drain downwardly toward the base 12. Preferably the female plug 86 is constructed with a combination of drain holes 70 and grooves to facilitate the removal of moisture from the interior of the support pole 30.

Referring to FIG. 12, the female plug 86 is preferably constructed to have a drain hole 98 running through the female plug 86. The drain hole 98 is large enough to allow water to pass through the female plug 86 and drain down toward the base 12. The drain hole 98 advantageously allows moisture from condensation, rain, snow, or the like that has collected inside the support pole 30 to drain. This aids in the prevention of rust and other detrimental effects caused by moisture. It is contemplated that the female plug 86 can be constructed with a plurality of drain holes 98. Further, the female plug could be constructed such that the outside diameter has grooves 100 that traverse the female plug's 86 longitudinal axis. Such grooves 100 will allow the moisture to drain downwardly toward the base 12. Preferably the female plug 86 is constructed with a combination of drain holes 98 and grooves along the female plug housing 84 to facilitate the removal of moisture from the interior of the support pole 30.

Figure 13:
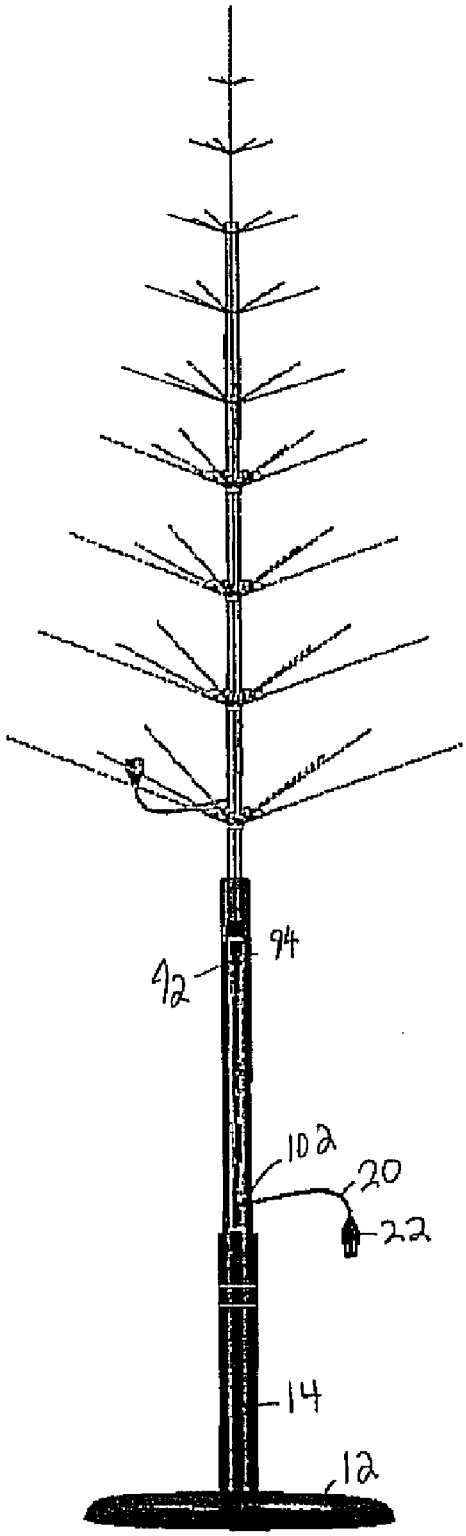
FIG. 13 is an enlarged view of the support pole, female plug, and male plug.

Referring now to FIG. 13, the elongated pole 16 is constructed with a hole 18 near the end extending into the elongated support pole 14 such that an electrical cord 20 may pass through the hole 18 into the elongated pole 16. The hole 18 is fitted with a grommet 102 to protect the electrical cord 20 from rubbing against the edge of the hole 18 in the elongated pole 16 and causing an electrical short. The electrical cord 20 is fitted with an electrical plug 22 at the bottom end of the electrical cord 20 that is adapted to plug into a standard outlet to receive electricity. The electrical cord 20 is run through the hole 18 and then upward through the elongated pole 16 where the ends of the electrical cord 20 are tied into the female plug 86 by securing the ends of the electrical cord 20 to the first receiving blade 88 and the second receiving blade 90 via the first receiving screw 92 and the second receiving screw 94 respectively. As the support pole 30 is inserted into the elongated pole 16 the male plug 52 is inserted into the female plug 86 such that the first blade 60 slides inside the first receiving blade 88 and the second blade 62 slides inside the second receiving blade 90. Thus, an electricity conducting connection between the male plug 52 and the female plug 86 is achieved. As such, when the electrical plug 22 is inserted into an electrical outlet, electricity becomes available to the electrical cord 20 and the electrical wire 72 via the connection between the male plug 52 and the female plug 86. Thus, electricity is provided to the decorative elements on the table top topiary 10.

It is contemplated that the decorative elements of the present invention can be of varying shapes, sizes, and characteristics. For example, the decorative elements can be shaped to form a Christmas tree appearance for use during the Christmas season. Further, the decorative elements could be arranged to appear like various characters or animals such as a rabbit during the Easter season or a turkey during Thanksgiving. Moreover, each of these decorative elements can have any number of attachments or adaptations to take advantage of electrical power. For example, the decorative elements can use lights, sounds, movements, etc.

It should be clear to anyone skilled in the art that the foregoing discussion and detailed description is only one preferred embodiment of the present invention. Accordingly, it is intended that the foregoing description and drawings are illustrative of a preferred embodiment only, are not limiting in any respect, and that the spirit of the present invention can be determined only by reference to the following claims. Thus, actual embodiments of the present invention may differ significantly from the foregoing description yet remain within the contemplated scope of the claimed invention. Accordingly, the invention claimed is embodied by the following claims.

What is claimed is:

1. An apparatus for displaying decorative elements comprising:

a. A first support pole;

b. A second support pole removably affixed to said first support pole;

c. Means to conduct electricity passing upwardly through the first support pole;

d. A female plug affixed to the end of the first support pole for transferring electricity from the first support pole to the second support pole, a male plug affixed to the end of the second support pole such that when the second support pole is inserted into the first support pole the male plug is inserted into the female plug;

e. An aligning slot corresponding to a protrusion on the male plug; and f. A plurality of rods affixed to the second support pole.

2. An apparatus for displaying decorative elements comprising:

a. A first support pole;

b. A second support pole removably affixed to said first support pole;

c. Means to conduct electricity passing upwardly through said first support pole;

d. Means for transferring electricity from said first support pole to said second support pole, said means further comprising a first end removably attached to a second end;

e. A plurality of rods affixed to the second support pole;

f. A support hub affixed to the second support pole, a plurality of rod supports affixed to the support hub, and a plurality of rods affixed to the support hub; and g. Protrusions from the interior of the rod supports to securely hold the rods at varying angles.

3. An apparatus for displaying decorative elements comprising:

a. A first support pole;

b. A second support pole removably affixed to said first support pole;

c. Means to conduct electricity passing upwardly through said first support pole;

d. Means for transferring electricity from said first support pole to said second support pole, said means further comprising a first end removably attached to a second end;

e. A plurality of rods affixed to the second support pole; and f. A support hub affixed to the second support pole, a plurality of rod supports affixed to said support hub, and a plurality of rods affixed to the support hub, wherein said rod supports include protrusions from the interior of said rod supports to securely hold said rods at varying angles.

* * * * *